US005697512A

United States Patent [19]

Brickley

[11] Patent Number: 5,697,512

[45] Date of Patent: Dec. 16, 1997

[54] TRAY OR PLATE ASSEMBLY

[76] Inventor: David A. Brickley, 138 Center Ave., Jim Thorpe, Pa. 18229

[21] Appl. No.: 677,227

[22] Filed: Jul. 9, 1996

[51] Int. Cl.[6] ..... B65D 1/24

[52] U.S. Cl. ..... 220/23.8; 220/575; 220/556; 220/914; 206/561; 206/564

[58] Field of Search ..... 220/23.8, 23.83, 220/23.86, 575, 574, 574.1, 914, 556, 17.1, 23.2, 505, 555, 507, 771, 628, 633, 635, 636, 755, 756; 206/518, 515, 561, 564, 565, 217

[56] References Cited

U.S. PATENT DOCUMENTS

| | | | |
|---|---|---|---|
| D. 211,532 | 6/1968 | Ashton | D44/10 |
| D. 227,851 | 7/1973 | Nowland et al. | D7/99 |
| 1,857,372 | 5/1932 | Gleason | 220/556 |
| 2,590,732 | 3/1952 | Simancik | 220/914 |
| 3,372,812 | 3/1968 | Parcels | 206/561 |
| 3,942,671 | 3/1976 | Florian | 220/23.8 |
| 3,955,672 | 5/1976 | Brundage | 206/562 |
| 4,291,805 | 9/1981 | Seeley | 206/564 |
| 4,732,274 | 3/1988 | Bouton | 220/3.8 |
| 4,867,331 | 9/1989 | Task | 220/23.8 |
| 4,989,742 | 2/1991 | Powell . | |
| 5,259,528 | 11/1993 | Pace et al. | 220/575 |
| 5,323,910 | 6/1994 | van de Graaf, Jr. | 206/564 |
| 5,346,070 | 9/1994 | McSpadden | 220/575 |
| 5,429,266 | 7/1995 | D'Oliveira et al. | 220/556 |
| 5,542,533 | 8/1996 | Vargas, III | 206/564 |

FOREIGN PATENT DOCUMENTS

| | | | |
|---|---|---|---|
| 3841770 | 6/1990 | Germany . | |
| 21883 | of 1902 | United Kingdom | 220/23.8 |

*Primary Examiner*—Stephen J. Castellano
*Attorney, Agent, or Firm*—Lane, Aitken & McCann

[57] ABSTRACT

An improved tray which can be held and stabilized using one hand and forearm is disclosed. The surface of the tray is positioned away from the forearm so that hot foods can be provided on the tray surface without injury or discomfort to one using the tray. A stabilizing member which has a shape generally conforming to the curvature of the forearm is positioned on one side of the tray and on the opposite side extends a cup holder. The stabilizer element and cup holder extend downwardly from the tray an equal distance which enables the device to be rested on a table or flat surface. A further feature of the invention allows for the nesting of the trays on top of one another for storage or shipping.

16 Claims, 4 Drawing Sheets

TRAY OR PLATE ASSEMBLY

BACKGROUND OF THE INVENTION

This invention relates to a tray assembly or device which can be stabilized using one hand and the forearm. In a preferred embodiment of the invention the tray is designed for food and beverage service.

The need for a manner in which to securely hold and stabilize trays is well recognized in the prior art and a number of inventions are directed to this problem. This need is particularly manifested in connection with those business and social engagements where guests are served either a meal or appetizers in a buffet like style. Such a need is also exhibited at sporting events. Although there is usually adequate seating at such events, patrons of the food service facilities often must rely on a cardboard service tray which usually requires two hands and is not convenient to eat from. In many instances circumstances created by the venue often render providing adequate table seating for the guests either inconvenient, impractical or undesirable. In such circumstances guests or customers are often left to struggle to eat while standing, precariously balancing a tray of food with one hand while using the other hand to eat. Those who choose to sit and eat are nevertheless faced with attempting to balance a plate or service tray on their laps, an undesirable option because the surface does not provide a particularly stable foundation. These problems are compounded in those situations where a guest further desires to drink a beverage with the food provided.

There have been a number of inventions directed at manners to securely hold a tray and cup and address the problems as referenced above. Many of the prior art devices are directed at coupling mechanisms which attach a cup, cup holder, can or wine glass to a plate or tray. These devices include arrangements in which the beverage container is positioned under, adjacent and on top of a plate or tray. Other prior art discloses using a cup or cup holder which is grasped by the hand as a single stabilizing element or support for a tray or plate. Still other prior art discloses the use of an opening through a tray to enable convenient engagement by the thumb and forefinger such as best illustrated by a traditional artist's palate. The patent to Brundage U.S. Pat. No. 3,955,672 discloses a plate assembly wherein a cup is inserted through an opening in a plate. Transversing the plate disclosed by Brundage is a ridge which is designed to engage the forearm and thereby stabilize the plate. Although Brundage's invention provided a suitable manner in which to stabilize a plate and cup, it had some disadvantages. For example, it incorporated an undesirable ridge across the plate and would not lay flat when set down with a beverage container in place. Notwithstanding the considerable efforts over the years at developing a convenient manner in which to hold a beverage container and plate or tray, completely satisfactory solutions have been elusive. It is an object of the invention to provide a tray device which can be securely stabilized with one hand and the forearm. It is further object of the invention to provide a tray device which elevates the bottom surface of the tray off the forearm. A further object of the invention is to provide a device which can be rested on a flat surface while maintaining the tray surface level. A further object of the invention is to provide a tray device having a flat surface which is appropriate for either eating food or writing. A further object of the invention is to provide a tray device that can be nested and stacked one on top of another. It is yet a further object of the invention to provide a device with a convenient area in which to keep utensils used in connection with the tray device as well as a beverage.

SUMMARY OF TIME INVENTION

The present invention is directed to an improved beverage holder and tray arrangement which further provides a novel first stabilizing element designed to engage the forearm near the elbow. The instant invention is directed to an improved tray device which can be held and stabilized with one hand and forearm. Like Brundage's device, the invention disclosed herein uses the forearm to stabilize the tray however it employs a device which raises the lower surface of the plate off the forearm. The device can be easily manufactured and molded from paper or synthetic resin. A first stabilizing member, which is generally cylindrical in shape, extends downwardly from the tray surface at a location adjacent to the tray. On the opposite side of the plate a second stabilizing element is provided which has an arcuate surface which generally conforms to the profile of the forearm. This surface is designed to engage the forearm near the elbow joint. The first and second stabilizer members extend downward from the tray an equal distance and form three legs. The apex of the arcuate surface is below the bottom surface of the tray. This arrangement serves both to elevate the tray from the forearm and enables the device to be laid on a flat surface without upsetting materials placed upon the tray. Elevating the tray from the forearm allows for the reception of hot food on the tray without causing injury or discomfort to the user. A further feature of the design allows the top surface of the tray to be flat. The assembly is designed to enable a number of units to closely nest against one another and to be stacked on top of one another to conserve space for storage and shipping.

In another embodiment of the invention a tray is provided with a spring biased clip designed to engage papers. The tray is stabilized by the forearm and hand in an analogous manner as that described in connection with the first embodiment.

DETAILED DESCRIPTION OF THE INVENTION

Figure 1:
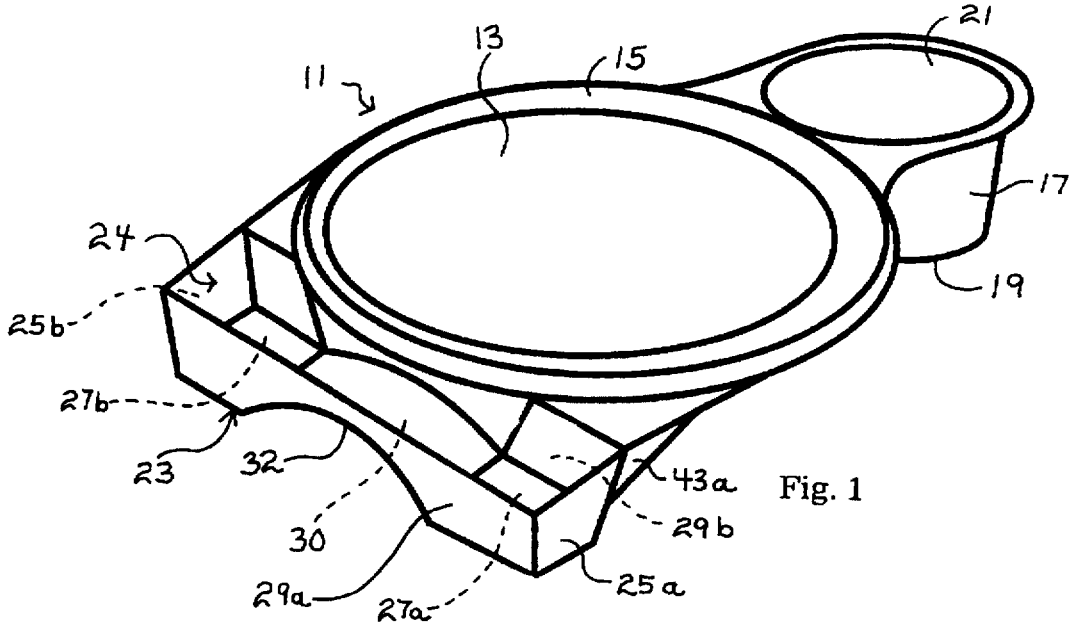
FIG. 1 is a perspective view of a first embodiment of the invention.

Referring now to FIG. 1, a tray assembly, generally designated by the reference numeral 11, is characterized by a flat planar section 13 surrounded by a ridge 15 and having a pair of stabilizing elements on opposite sides. On a first side and adjacent to flat section 13 is a first stabilizing element 17 in the form of hollow conical section which extends downwardly from a plane broadly defined by flat section 13. The sidewall of the conical section slightly tapers inward as it extends downward until it reaches a circular bottom area 15. The top of first stabilizing element defines a circular opening 21 which is sized to receive a conventional beverage container such as a can or cup. Although other shapes for the first stabilizing element are contemplated, a hollow conical section is preferred because it will allow for the reception of conventional beverage vessels such as cans, cups, glasses or tumblers and it provides a structure in which the tray assembly can be nested adjacent to an additional identical assembly or assemblies. Located on the opposite side and adjacent to flat section 13 is a second stabilizing element 23. The second stabilizing element also extends downwardly from a planar surface broadly defined by flat section 13. Second stabilizing element 23 has a rectangular opening 24 defined by two endwalls 25*a* and 25*b* and two sidewalls 29*a* and 29*b* each of which extend downwardly and inwardly. Like the first stabilizing element, second stabilizing element 23 defines a space in which the walls taper inwardly as they approach the bottom. The tapered sidewall configuration of the first and second stabilizing elements allows for multiple assemblies to be nested against each other. In this first embodiment, the rectangular space is provided in order to conveniently receive eating utensils such as a knife, fork and spoon used in connection with the plate. The floor of second stabilizing element 23 is made up of three regions, flat sections 27*a* and 27*b* which are connected by a third region, arcuate surface 30. Arcuate surface 30, which is positioned adjacent to and below the flat section 13 of the assembly, is curved to receive the upper surface of the forearm. Flat bottom sections 27*a* and 27*b*, along with bottom area 19 on first stabilizing element, form three legs on which the tray assembly can be rested.

Figure 2:
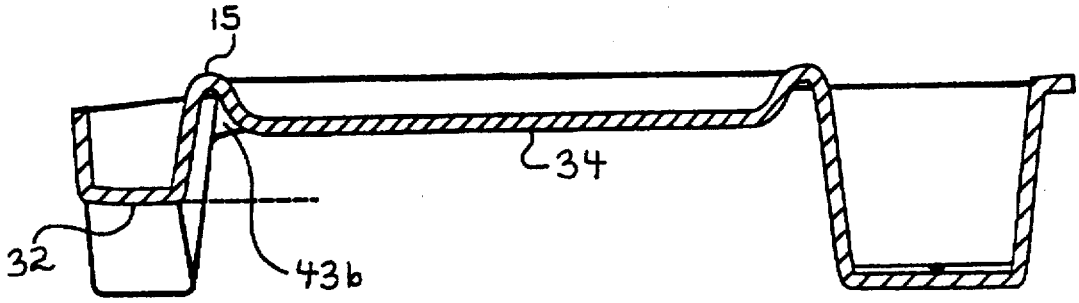
FIG. 2 is a side view in section of the first embodiment of the invention.

As best seen in FIG. 2, the apex 32 of the arc surface 30 is located well below the lower surface 34 of flat section 13. The arced surface 30 is curved to generally conform to the shape of the forearm near the elbow. When the first stabilizing element is grasped by the hand and the tray is oriented in a horizontal position, the second stabilizing element rests on the forearm. This arrangement provides a generous space between the lower surface 34 of the flat section 13 and the forearm which extends beneath the surface. Second stabilizing element 23 thus elevates the lower surface 34 of the tray area above and off the forearm. The elevated position created by the cooperation of first stabilizing element 17 and second element 23 allows for the reception of hot substances on the upper surface 13 of the tray section without concern that the substance will burn or cause discomfort to the user. The positioning of the stabilizing element adjacent to and below the flat area further serves to stabilize the assembly so that a user can securely hold and carry a tray loaded with food with a single appendage.

Figure 3:
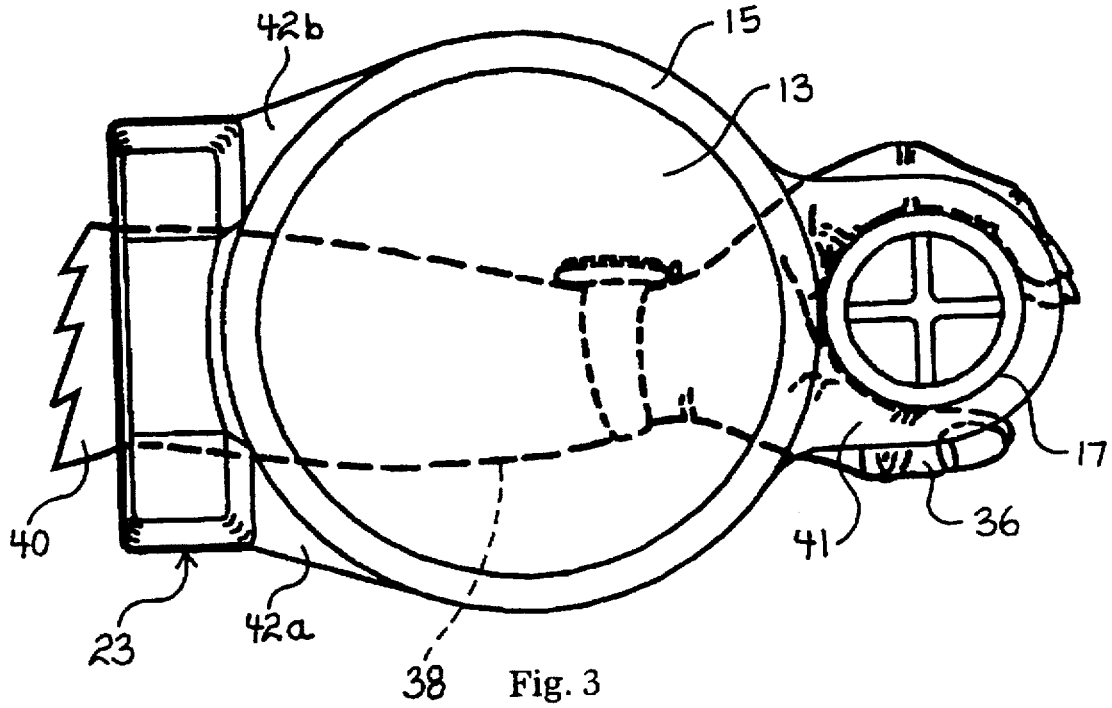
FIG. 3 is a top view of the first embodiment of the invention showing the engagement of the tray by the hand and forearm.

FIG. 3 shows a top view of the tray assembly and its cooperation with a hand 36 and forearm 38. First stabilizing element 17 is shown engaged by the hand 36 and is connected to ridge 15 of the flat section by an extended rim 41. The diameter of the first element has an outer dimension which enables the stabilizing element to be comfortably grasped by the hand. The device is oriented so that second element 23 receives the upper side of the forearm 38 near the elbow joint 40 of the forearm. Second stabilizing element 23 is connected to rim 15 on the opposite side of flat section 13 by support elements 42*a* and 42*b* as well as support members 43*a* and 43*b*.

Figure 4:
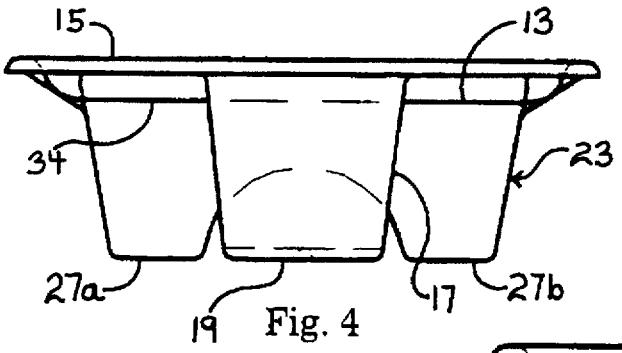
FIG. 4 is an end view in elevation of the first embodiment of the invention.
Figure 5:
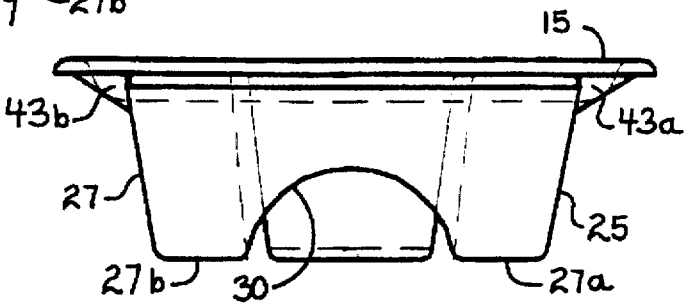
FIG. 5 is an end view in elevation of the first embodiment of the invention.

As best seen in FIGS. 4 and 5, bottom surface 19 of the first stabilizing element and surfaces 27*a* and 27*b* of the second stabilizing elements extend equal distances perpendicularly downward from a plane defined by the flat section 13. This feature allows the assembly to be set down on a flat surface while maintaining the flat section 13 in a horizontal position.

FIG. 5, a rear view of the first embodiment, further shows the arcuate surface 30 designed to receive the forearm and also shows both support members 43*a* and 43*b* extending from the endwalls 25*a* and 25*b* respectfully to rim 15.

Figure 6:
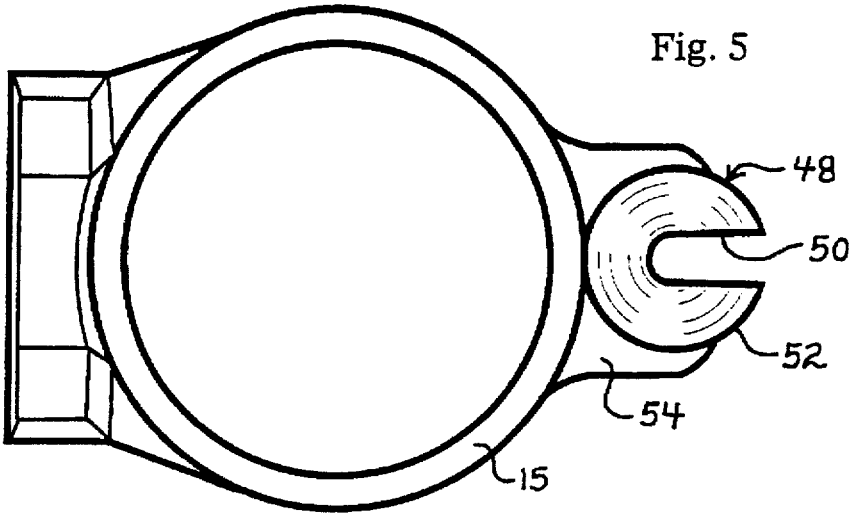
FIG. 6 is a top view of a second embodiment of the invention
Figure 7:
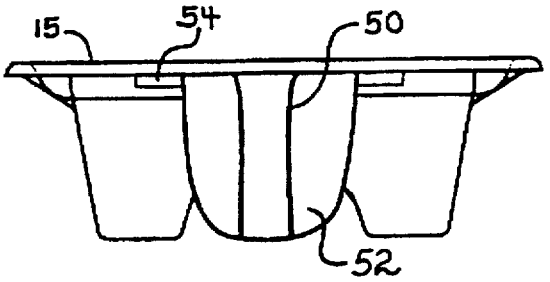
FIG. 7 is an end view in elevation of a second embodiment of the invention.

FIGS. 6 and 7 depict a second embodiment of the invention wherein a first stabilizing element 48 is designed to receive a wine glass or goblet. In this embodiment a slot 50 extends through sidewall 52 of first stabilizing element 48 and terminates near the center of the bottom. In this embodiment, as best illustrated in FIG. 7, the stabilizing element 48 has a rounded, semi-spherical or bullet shape designed to receive stemware wherein the sidewall 52 generally conforms to the shape of a wine glass or goblet. A support rim 54 serves to connect the stabilizing element to the remainder of the assembly. In this embodiment the remainder of the assembly is conformed as depicted in FIGS. 1–5 and described above.

Figure 8:
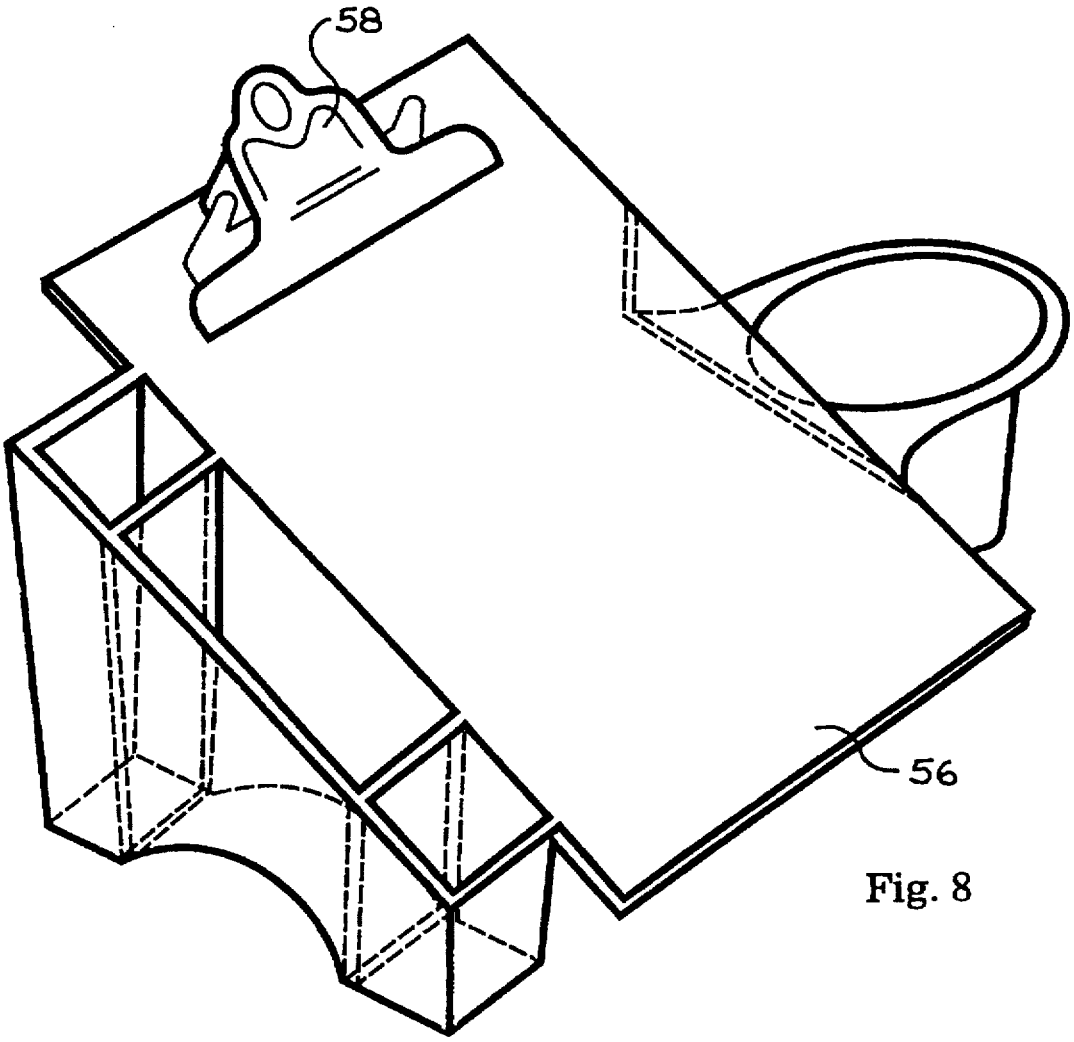
FIG. 8 is a perspective view of a third embodiment of the invention.

In FIG. 8 yet another embodiment of the invention is shown. In this embodiment, a flat section 56 is shown as a rectangular surface which is suitable for writing or drawing. On one side of the rectangular surface 56 a conventional spring biased clip 58 is provided which can secure papers, forms or the like. In yet another contemplated embodiment of the invention the surface is designed to receive electronic equipment such as a calculator or computer.

Although the embodiments depicted in FIGS. 1 through 8 show the second stabilizing element as a curved planar surface, it is contemplated that additional arced or curved stabilizing elements located adjacent and below the flat section would be effective. For example, a curved or arcuate rod having a suitable linkage to the flat section would also serve to suitably stabilize the assembly according to the invention. These contemplated embodiments can also be designed to nest against one another by forming the element outside the periphery of the tray area.

The invention has disclosed in FIGS. 1–7 can easily receive a conventional circular paper plate on flat section 13 or flat section 13 itself can serve as a plate. In a preferred embodiment of the invention the entire assembly is made of paper or fiberboard and is disposable however it is contemplated that other materials would be suitable to construct the device such as synthetic resin, aluminum or stainless steel.

The invention has been shown and described in the preferred form only and it is contemplated that additional variations may be made of the invention which would still be included within its spirit and scope. It is accordingly understood that the invention is not limited to the particular embodiments or forms described herein except insofar as such limitations are included in the appended claims.

I claim:

1. An improved tray device comprising a tray area which is generally planar and has an upper and lower surface, a first stabilizing element extending downward from said lower planar surface from a first side of said tray area and terminating a predetermined distance from the planar upper surface, and a second stabilizing element located on the opposite side of said tray area, said second stabilizing element further comprising a continuous curving surface, said curving surface terminating in two ends, wherein the ends of said curved surface extend downward from the tray area and terminate at positions the same distance from the upper surface as an end of said first stabilizing element and said first and said second stabilizing elements are separated from each other a distance the length of a human forearm.

2. The tray device as recited in claim 1, wherein said tray device further comprises a conventional round plate supported by an annular ring.

3. An improved tray device comprising a tray area which is generally planar and has an upper and lower surface, a first stabilizing element extending downward from a first side of said tray area and terminating at a bottom, said first stabilizing element cylindrically shaped and adapted to be grasped by a hand, a second stabilizing element located on the opposite side of said tray area, said second stabilizing element further comprising an arcuate surface, said arcuate surface having an apex and terminating at a first and second end, said arcuate surface defining an arc having a dimension which generally conforms to the shape of the top of a person's forearm, said first and said second end and said bottom terminating at the same distance below said upper tray area, said bottom of said first stabilizing element and said first and second ends define three legs, and said apex of said arcuate surface is located below said lower surface of said tray area wherein when said first stabilizing element is engaged by the hand and said second stabilizing element is received on the forearm, a space remains between said forearm and said lower surface of said tray area.

4. The tray device as recited in claim 3 wherein said upper and said lower surface are flat.

5. The tray device as recited in claim 3 wherein said first stabilizing element is cylindrical and hollow and has an opening accessible from said upper surface wherein said cavity can receive a can or cup.

6. The tray device as recited in claim 3 wherein said first stabilizing element is a hollow conical section wherein the sidewall of said hollow conical section defines a circular opening and said sidewall tapers inwardly as it extends downward from a plane defined by said tray area.

7. The tray device as recited in claim 3 wherein said first, said second and said third legs terminate at a position beyond the periphery of said tray area.

8. The tray device as recited in claim 3 wherein said first stabilizing element further comprises sidewalls which define a hollow cylinder with a semi-spherical bottom and an circular opening at the top, said sidewalls further comprising a slot initiating at said circular opening and extending through said sidewalls to a center region of said bottom wherein said slot is sized to receive a stem from a goblet and wherein said sidewall can receive and cradle the vessel area of said goblet.

9. The tray device as recited in claim 3 wherein said tray area has a raised rim provided around the circumference of said upper surface wherein said rim contains material placed on said tray.

10. The tray device as recited in claim 9 wherein said raised rim defines a circle.

11. The tray device as recited in claim 3 wherein said second stabilizing element further comprises a receptacle having an opening adjacent to said upper surface of said tray area, sidewalls and a bottom and has dimensions to receive eating utensils situated in a horizontal position.

12. The tray device as recited in claim 11 wherein a portion of said bottom of said receptacle is defined by said arcuate surface.

13. The tray device as recited in claim 11 wherein said opening is in the shape of a rectangle.

14. The tray device as recited in claim 3 wherein a spring biased clip is attached to said tray area.

15. The tray assembly as recited in claim 3 wherein said first and said second stabilizing elements are integrally formed with said tray area.

16. The tray device as recited in claim 3 wherein said tray device can be nested against additional identical tray devices.

* * * * *